US006358012B1

(12) United States Patent
Staubach

(10) Patent No.: US 6,358,012 B1
(45) Date of Patent: Mar. 19, 2002

(54) HIGH EFFICIENCY TURBOMACHINERY BLADE

(75) Inventor: J. Brent Staubach, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/561,997

(22) Filed: May 1, 2000

(51) Int. Cl.[7] ..... F04D 29/38
(52) U.S. Cl. ..... 416/228; 416/236
(58) Field of Search ..... 416/228, 223, 416/241 B, 236 R, 244 R; 415/914, 169.3, 191, 208.1, 208.2

(56) References Cited

U.S. PATENT DOCUMENTS

| | | | | |
|---|---|---|---|---|
| 2,819,837 A | | 1/1958 | Loeb | 230/127 |
| 2,935,246 A | | 5/1960 | Roy | 230/120 |
| 3,000,401 A | | 9/1961 | Ringleb | 138/39 |
| 3,077,173 A | | 2/1963 | Lang | 114/66.5 |
| 3,333,817 A | | 8/1967 | Rhomberg | 253/77 |
| 3,409,968 A | * | 11/1968 | Denes | 416/228 |
| 3,993,414 A | | 11/1976 | Meauze et al. | 415/181 |
| 4,123,196 A | | 10/1978 | Prince, Jr. et al. | 415/181 |
| 4,408,957 A | | 10/1983 | Kurzrock et al. | 416/237 |
| 5,554,000 A | | 9/1996 | Katoh et al. | 415/208.2 |
| 5,676,522 A | | 10/1997 | Pommel et al. | 415/181 |
| 5,904,470 A | | 5/1999 | Kerrebrock et al. | 415/115 |

* cited by examiner

*Primary Examiner*—Edward K. Look
*Assistant Examiner*—James M McAleenan
(74) *Attorney, Agent, or Firm*—Kenneth C. Baran

(57) ABSTRACT

A turbomachinery blade for use in a turbine blade array, has a suction surface contour featuring chordwisely separated, positively curved forward and aft segments 35, 36 and a negatively curved medial segment 37 chordwisely intermediate the forward and aft segments. When used in an array of similar blades operated in a transonic environment, the inventive blade mitigates overexpansion of working medium fluid flowing through the interblade passages 17. As a result, subsequent recompression of the fluid by an aerodynamic shocks 31, 32 is less severe, and aerodynamic inefficiencies related to the presence of the shocks are reduced.

28 Claims, 6 Drawing Sheets

HIGH EFFICIENCY TURBOMACHINERY BLADE

TECHNICAL FIELD

This invention relates to turbomachinery blades and particularly to a blade having a unique suction surface contour that mitigates shock induced aerodynamic losses.

BACKGROUND OF THE INVENTION

Gas turbine engines and similar turbomachines employ a turbine to extract energy from a stream of working medium fluid. A typical axial flow turbine includes one or more arrays of blades that project radially from a rotatable hub. The blades circumferentially bound a series of interblade fluid flow passages. Under some operating conditions, the working medium may accelerate to a supersonic speed as it flows through the interblade passages. The fluid acceleration produces expansion waves; subsequent deceleration produces compression waves and an accompanying primary shock that originate near the trailing edge of each blade and extend across the passage to the suction surface of the neighboring blade. A secondary or "reflected" shock, related to the primary shock, may also develop. The secondary shock extends into the working medium fluid stream downstream of the blade array.

The shocks degrade turbine efficiency by causing an unrecoverable loss of the fluid stream's stagnation pressure. The shocks also interact with the fluid boundary layer attached to the suction surfaces of the blades, causing the boundary layer to enlarge and thereby introducing additional aerodynamic inefficiencies. The shocks also introduce static pressure pulses into the fluid stream. These pressure pulses impinge upon turbine components downstream of the blade array and subject those components to increased risk of high frequency fatigue failure. Clearly, it is desirable to eliminate or mitigate these adverse effects of the shocks to ensure peak turbine efficiency and to enhance the durability of the turbine components.

SUMMARY OF THE INVENTION

It is, therefore, a principal object of the invention to provide a turbomachinery blade that influences the pattern of expansion waves and shocks in a way that weakens or eliminates the shocks.

According to one aspect of the invention, the airfoil of a turbomachinery blade has a uniquely contoured suction surface with chordwisely separated, positively curved forward and aft segments and a negatively curved medial segment residing chordwisely intermediate the positively curved segments. The medial segment may extend across substantially the entire span of the blade or may be spanwisely localized. When used in a turbomachinery blade array, the medial segment limits expansion of the fluid stream as it accelerates through the passages. Consequently, the degree to which a shock must subsequently recompress and decelerate the fluid stream to satisfy the aerodynamic boundary conditions imposed on the fluid stream is similarly limited. As a result, the primary and secondary shocks are weaker and therefore less detrimental to turbine efficiency. Under some conditions, the secondary shock may not even materialize.

The principal advantage of the invention is the improved efficiency arising from reduced aerodynamic losses. A related advantage is the reduced risk of exposing the turbine components to premature high frequency fatigue failure.

The foregoing objects and advantages and the operation of the invention will become more apparent in light of the following description of the best mode for carrying out the invention and the accompanying drawings.

BEST MODE FOR CARRYING OUT THE INVENTION

Figure 1:
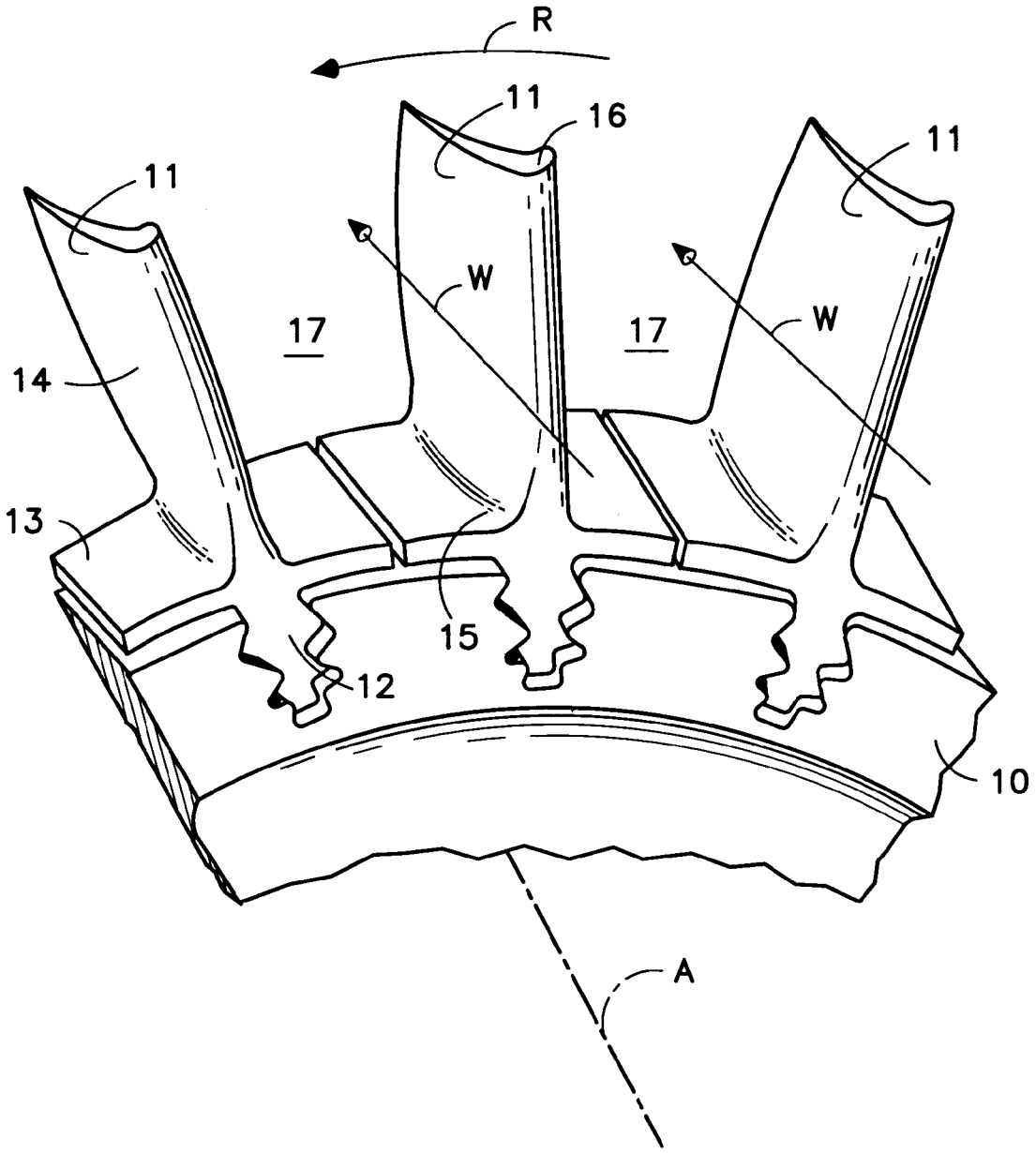
FIG. 1 is a simplified perspective view showing a fragment of a turbine rotor disk and three representative blades secured to the disk.

Referring to FIG. 1, a turbine module for a gas turbine engine includes a rotatable hub 10 and an array of blades 11 projecting radially therefrom. Each blade has an attachment 12 that engages a slot in the hub, a platform 13 and an airfoil 14 that extends radially or spanwisely from an airfoil root 15 to an airfoil tip 16. The airfoils circumferentially bound a plurality of interblade passages 17. During operation, a working medium fluid W flows through the interblade passages causing the hub to rotate in direction R about module axis A.

The turbine module also includes one or more nonrotatable arrays of stator vanes, not shown. The principles of the invention apply to the vanes as well as the blades. Accordingly, as used throughout this specification and the accompanying claims, the term blades means both the rotatable blades and the nonrotatable vanes.

Figure 2:
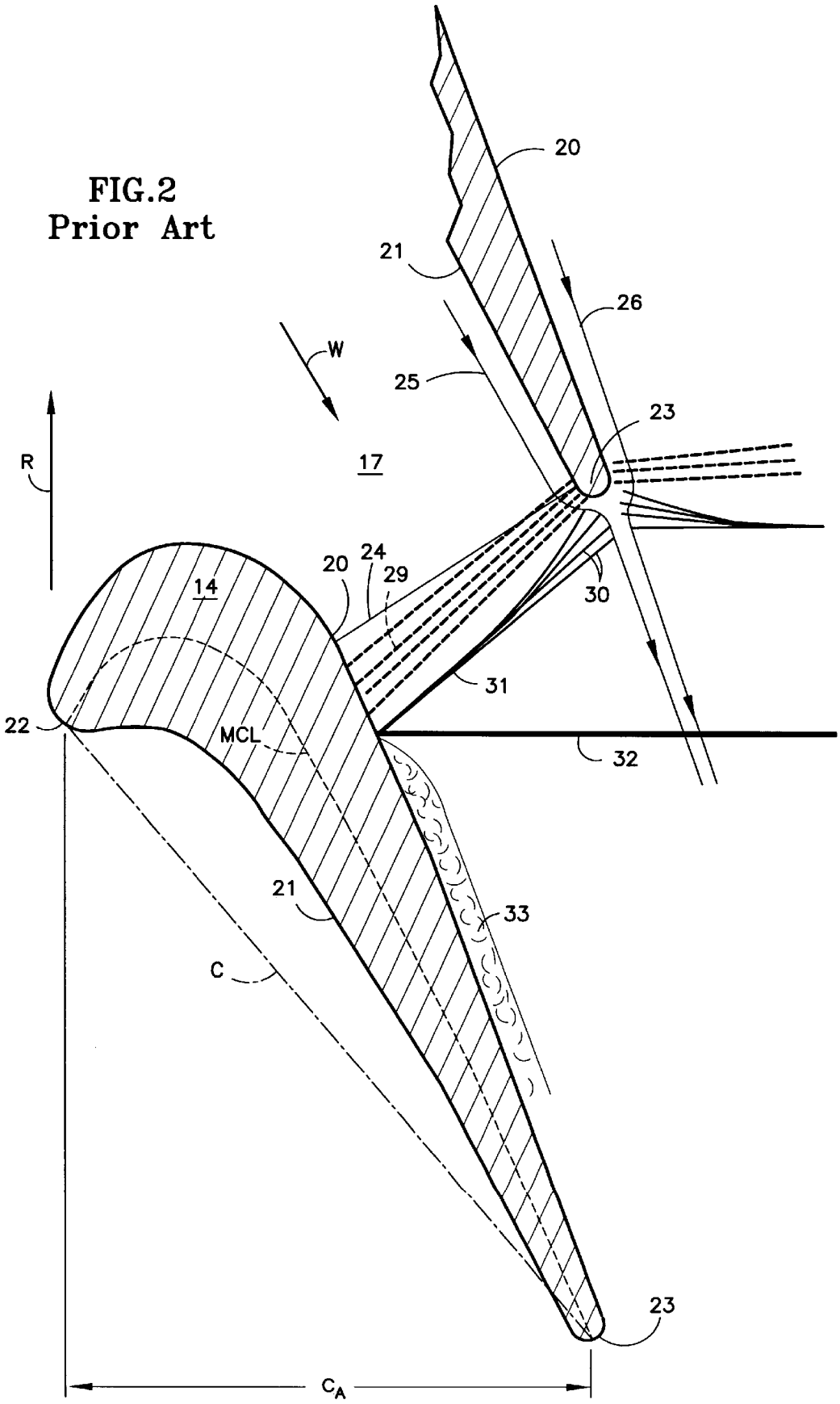
FIG.2 Prior Art
FIG. 2 is a cross sectional view showing a prior art turbine blade and the associated expansion waves, compression waves and shocks.

Referring to FIG. 2, a typical turbine airfoil 14 has a suction surface 20 and a pressure surface 21. The suction and pressure surfaces meet at a leading edge 22 and a trailing edge 23 but are otherwise laterally spaced from each other. A mean camber line MCL is a line midway between the pressure and suction surfaces as measured perpendicular to the mean camber line. A chord line C is a straight line that extends from the leading edge to the trailing edge and joins the ends of the mean camber line. The airfoil has an axial chord $C_A$, which is a projection of the chord line C onto a plane that contains the axis A. Each interblade passage 17 has a minimum cross sectional area or throat 24.

During operation, the working medium fluid stream W flows through the passages in a direction generally perpendicular to the throat. As the fluid flows through the passages, the static pressure of the fluid drops and the fluid accelerates from a subsonic speed at the passage inlet to a supersonic speed upstream of the throat. As the fluid flows past the trailing edge 23 of an airfoil, it momentarily turns away from the main flow direction as indicated by the streamlines 25, 26, and then turns back toward the main flow direction as fluid flowing over the suction surface reunites with fluid flowing over the pressure surface. The first directional change "overexpands" the fluid stream. The overexpansion manifests itself as a "fan" of expansion waves 29 that extend across the interblade passage 17 from the trailing edge of a blade to the suction surface of the neighboring blade.

The overexpansion is incompatible with the aerodynamic boundary conditions imposed on the fluid stream. Accordingly, compression waves 30 associated with the second directional change of the fluid streamlines 25, 26 materialize just downstream of the expansion waves. The compression waves coalesce into a primary shock 31 that extends to the suction surface of the neighboring blade. The compression waves and primary shock recompress the fluid to conform to the existing boundary conditions. The primary shock "reflects" off the suction surface and establishes a "reflected" or secondary shock 32. The secondary shock is typically weaker than the primary shock, however both shocks reduce the stagnation pressure of the fluid stream and therefore degrade turbine efficiency. The shocks also introduce static pressure pulses into the fluid stream. These pressure pulses impinge upon turbine components downstream of the blade array and subject those components to increased risk of high frequency fatigue failure. The primary shock also interacts with boundary layer 33 on the suction surface of the neighboring blade, causing the boundary layer to thicken, thereby introducing additional inefficiencies.

Figure 3:
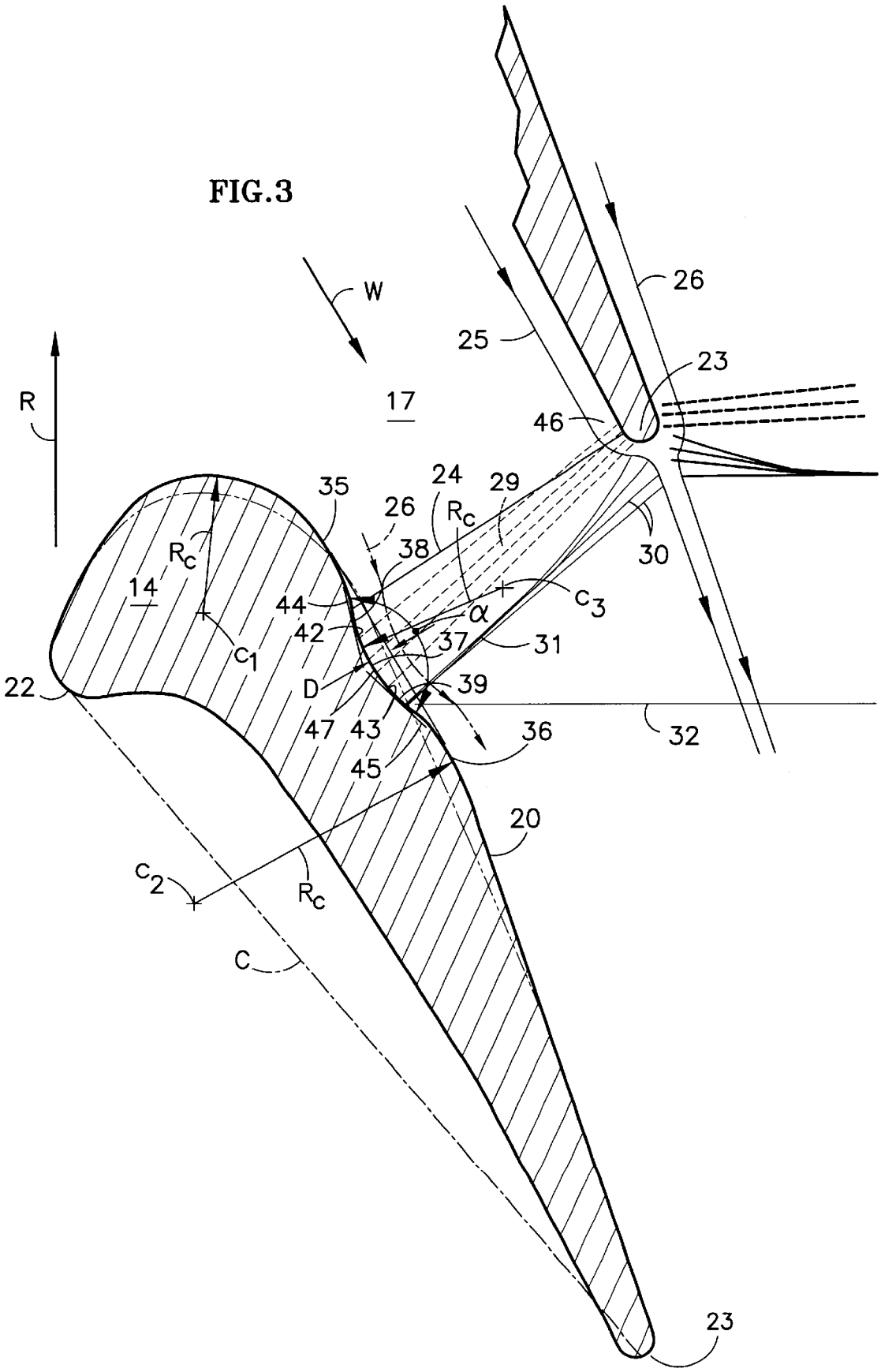
FIG. 3 is a cross sectional view showing a blade of the present invention and the associated expansion waves, compression waves shocks.
Figure 4:
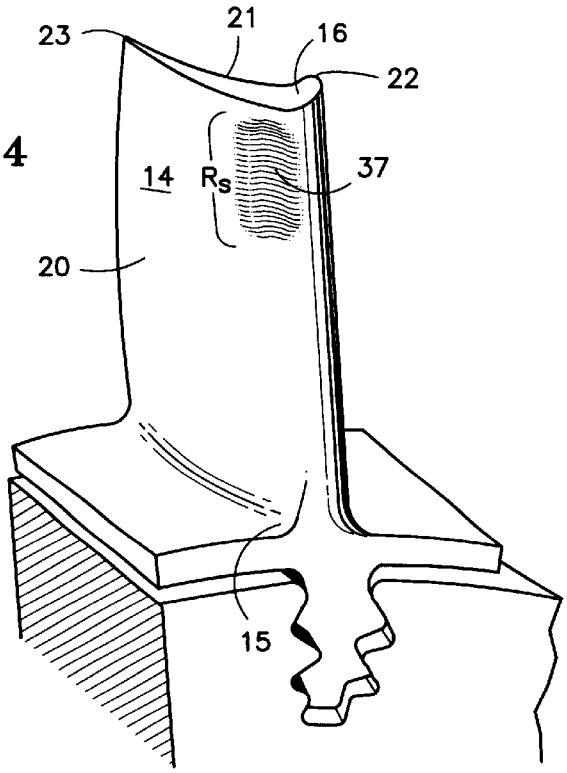
FIGS. 4 and 5 are perspective views showing two possible embodiments of the inventive turbine blade.
Figure 5:
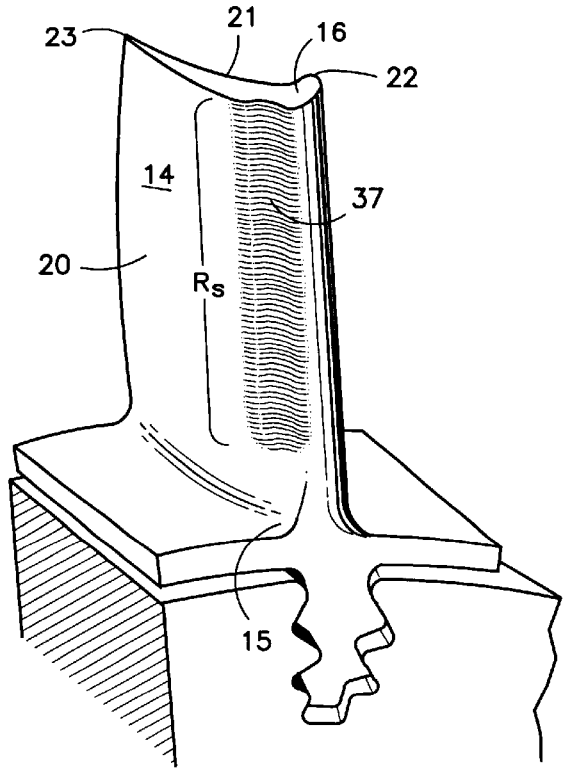

Referring to FIGS. 3–5, but primarily to FIG. 3, the inventive turbomachinery blade comprises an airfoil 14 having an airfoil root 15, a tip 16 spanwisely spaced from the root, a suction surface 20 and a pressure surface 21 laterally spaced from the suction surface, the suction and pressure surfaces being joined together at a leading edge 22 and at a trailing edge 23 chordwisely spaced from the leading edge. For comparison, the suction surface of a representative prior art blade is also shown in phantom on FIG. 3.

The suction surface may be described by its curvature which, in general, varies chordwisely along the suction surface so that each point on the surface has its own radius of curvature, generally designated $R_c$, emanating from a corresponding center of curvature, generally designated c. Each center of curvature is offset from the surface in either a positive direction (away from the interblade passage 17 bounded by the suction surface) or in a negative direction (toward the interblade passage 17 bounded by the suction surface). The curvature at any point on the suction surface is positive if the offset direction is positive; the curvature is negative if the offset direction is negative. The curvature of a straight line is zero.

The airfoil of the inventive blade has chordwisely separated, positively curved forward and aft segments 35, 36 and a negatively curved medial segment 37 chordwisely intermediate the forward and aft segments. Blend regions or junctures 38, 39 join the medial segment to the forward and aft segments. The forward and aft segments are considered positively curved because each point along those segments has a center of curvature (e.g. $c_1$ or $c_2$) offset from the surface in a direction away from the interblade passage 17. The medial segment is considered negatively curved because each point along the segment has a center of curvature (e.g. $c_3$) offset from the surface in a direction toward the interblade passage 17. The curvature of the illustrated segments and the corresponding depth D of the medial segment are exaggerated for clarity. For example, in an actual blade manufactured by the assignee of the present application, the depth D of the negatively curved medial segment varies in the spanwise direction from about 0.3% chord to 1.4% chord with the smaller depth occurring where the fluid stream Mach number is smaller, and the larger depth occurring where the Mach number is greater. The depth D may be larger than 1.4% depending on the requirements of a given application.

The medial segment 37 has a descending surface 42 and an ascending surface 43. Notional reference lines 44, 45, one tangent to any arbitrary point on the descending surface and one tangent to any arbitrary point on the ascending surface, define an angle a greater than 0° but less than 180°. As a result, the medial segment is substantially exposed to the working medium fluid. The medial segment may be spanwisely localized as seen in FIG. 4 or may extend across substantially the entire span of the airfoil as seen in FIG. 5.

The blend regions 38, 39 may be linear regions of finite length or may be single transition points as shown. In either case, the regions of blend between the medial segment and the forward and aft segments are nonabrupt, i.e. devoid of sharp edges, corners, cusps or other angular features.

The airfoil of the inventive blade may also be described as having chordwisely separated, convex forward and aft segments 35, 36 and a concave medial segment 37 chordwisely intermediate the forward and aft segments.

Figure 6A:
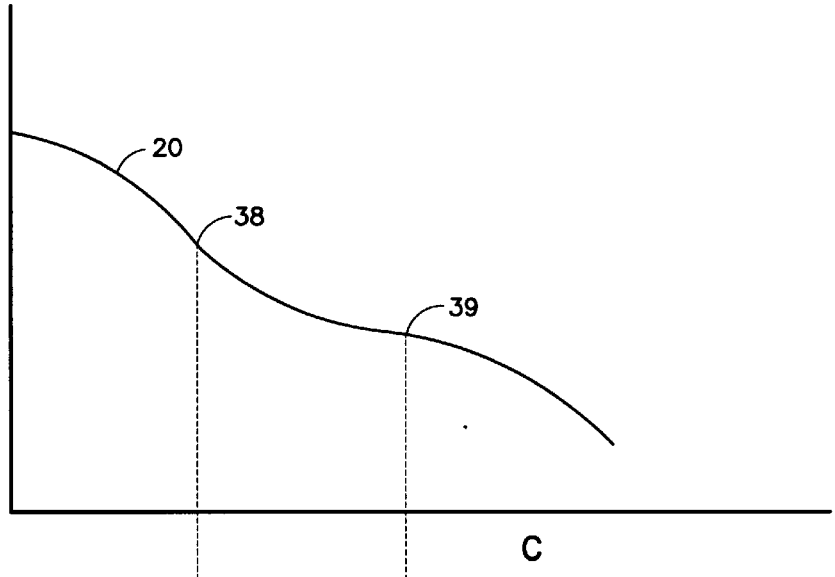
FIG. 6 is a sequence of graphs showing the unique suction surface contour of the inventive blade represented as a curve on a Cartesian coordinate system (FIG. 6A) and also showing the derivative and second derivative of the curve (FIGS. 6B and 6C respectively).
Figure 6B:
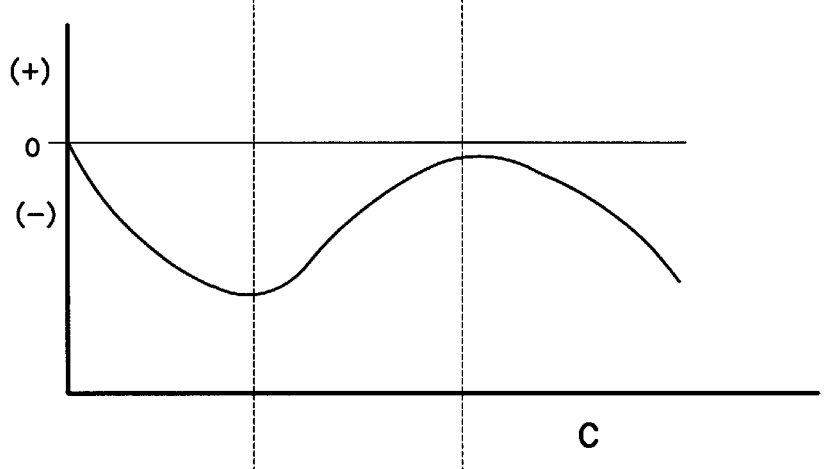
Figure 6C:
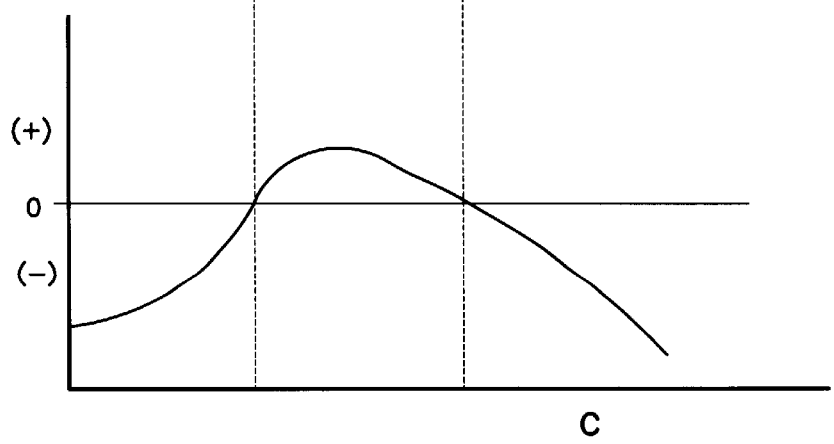

Referring now to FIG. 6, The suction surface contour of the inventive airfoil may also be described in mathematical terms. In FIG. 6A, a part of the suction surface 20 that includes the forward, medial and aft segments is represented as a continuous curve in the positive quadrant of a planar Cartesian coordinate system. The coordinate system has conventional abscissa and ordinate axes. Abscissa values represent distance along the airfoil chord line C. The curve has a continuous first derivative and a second derivative. The curve is oriented on the coordinate system so that each point on the curve has a single ordinate value uniquely associated with each abscissa value and so that the first derivative at the ordinate axis is zero (FIG. 6B). With the curve so positioned and oriented, the suction surface has a second derivative that changes sign at least twice, over the spanwise range $R_s$ indicated in FIGS. 4 and 5. For the surface shown in FIG. 6, the sign changes exactly twice, and each change of sign occurs at the junctures 38, 39 between the positively and negatively curved segments.

Figure 7:
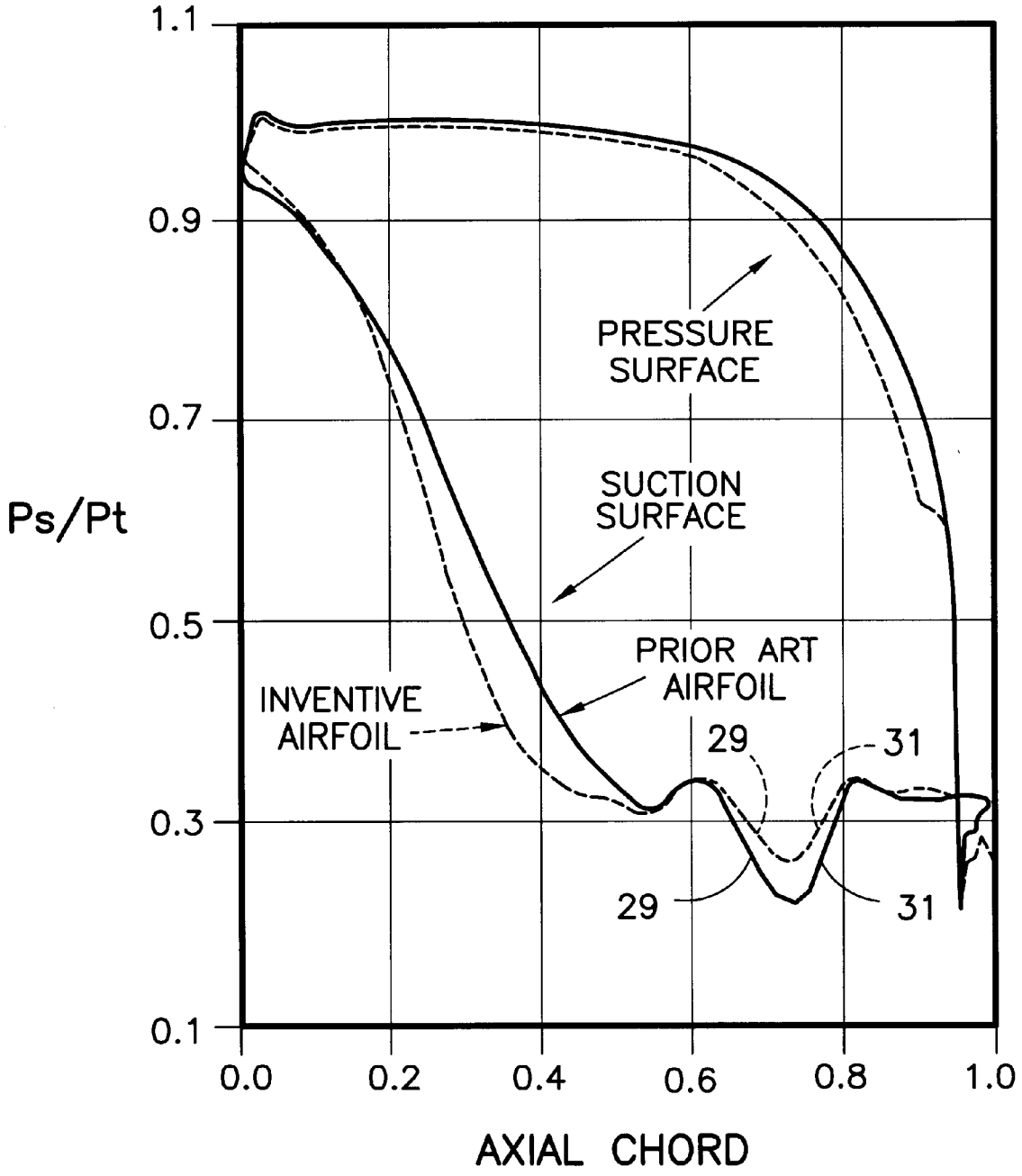
FIG. 7 is a graph comparing fluid pressure near the surfaces of the inventive turbine blade to fluid pressure near the surfaces of a prior art blade.

The operation of the inventive blade in comparison to that of a prior art blade is best understood by reference to FIGS. 2, 3 and 7. FIGS. 2 and 3 show the expansion waves 29, compression waves 30 and shocks 31 and 32 arising when a prior art blade and an inventive blade are used in a blade array. FIG. 7 shows the ratio of static pressure to stagnation pressure along the pressure and suction surfaces of both the prior art blade of FIG. 2 (solid lines) and the inventive blade of FIG. 3 (broken lines) when operating in a blade array. The blades are illustrated as operating in a transonic environment, i.e. the fluid stream enters the interblade passages 17 at a subsonic relative velocity and accelerates to a supersonic relative velocity within the passages.

Referring primarily to FIG. 3, a fan of expansion waves 29, extends across the interblade passage due to fluid turning away from the main flow direction as indicated by streamline 25 near trailing edge 23. The expansion waves extend across the passage at approximately the passage throat, which is the minimum cross sectional area of the passage. The expansion waves have a first end 46 adjacent the trailing edge 23 of one blade and a second end 47 adjacent the suction surface 20 of the neighboring blade. The medial segment 37 of the neighboring airfoil is substantially chordwisely aligned with the second end of the expansion wave.

The fluid stream W follows the contour of the suction surface as indicated by streamline 26 and, in doing so, locally changes direction as it flows past the descending surface 42 and then over the ascending surface 43. The directional change compresses the fluid to at least partially compensate for the expansion represented by expansion waves 29. As a result, the local overexpansion typical of prior art blades (feature 29 in FIG. 2) is mitigated. This can be seen clearly in FIG. 7 which compares the local static pressure drop arising from expansion waves 29 of the prior art and inventive blades respectively.

Following the localized expansion 29, shock 31 compresses the fluid to satisfy the boundary conditions imposed on the fluid stream. Because the inventive airfoil mitigates overexpansion of the fluid stream as discussed above and as seen in FIG. 7, shock 31 (FIG. 3) does not need to be as strong, i.e. as compressive, as corresponding shock 31 associated with the prior art blade of FIG. 2. In addition, the compressive strength of shock 31 (FIG. 3), which is typically aligned with the positively curved aft segment 36, is further mitigated by a compensatory expansion that occurs as the fluid near the suction surface follows the directional change from the ascending surface 43 to the aft segment 36 and turns back in the direction of the main flow. The reduced shock strength is clearly visible in FIG. 7 where the pressure rise 31 associated with the inventive blade is smaller than the corresponding pressure rise resulting from the prior art blade. Secondary shock 32 also becomes weaker or may not even materialize. The reduced strength of shocks 31, 32 (FIG. 3), as compared to corresponding shocks 31, 32 (FIG. 2), reduces undesirable losses in the fluid stream's stagnation pressure and reduces the interactions that cause undesirable growth of the boundary layer 33 (FIG. 2). Reduced shock strength also attenuates potentially damaging static pressure pulses that impinge on turbine components downstream of the shocks.

Typically, the full complement of blades used in a turbine blade array would be of the inventive variety described above. However the inventive blades may also be intermixed with conventional blades in the same blade array so that the inventive blades constitute only a subset of the blade complement. Such intermixing may be desirable because of predictable circumferential nonuniformities that cause shocks 31, 32 to form in fewer than all the passages. For example, such nonuniformity might arise due to the presence of a stator vane array whose blade count is dissimilar in each of two 180° sub-arrays. Such dissimilar sub-arrays have been used to prevent excessive vibration that can occur if airfoils downstream of the blade array are exposed to the repetitive pressure pulses produced by an axisymmetric blade array.

Although the invention has been described with reference to a preferred embodiment thereof, those skilled in the art will appreciate that various changes, modifications and adaptations can be made without departing from the invention as set forth in the accompanying claims.

I claim:

1. A turbomachinery blade for use in a blade array, the blade comprising an airfoil having a root, a tip spanwisely spaced from the root, a suction surface and a pressure surface laterally spaced from the suction surface, the suction and pressure surfaces being joined together at a leading edge and at a trailing edge chordwisely spaced from the leading edge, the suction surface having chordwisely separated, positively curved forward and aft segments and a negatively curved medial segment chordwisely intermediate the forward and aft segments.

2. A turbomachinery blade for use in a blade array, the blade comprising an airfoil having a root, a tip spanwisely spaced from the root, a suction surface and a pressure surface laterally spaced from the suction surface, the suction and pressure surfaces being joined together at a leading edge and at a trailing edge chordwisely spaced from the leading edge, the suction surface having chordwisely separated, convex forward and aft segments and a concave medial segment chordwisely intermediate the forward and aft segments.

3. The turbomachinery blade of claim 1 or 2 wherein the medial segment blends nonabruptly with the forward and aft segments.

4. The turbomachinery blade of claim 1 or 2 wherein the medial segment is substantially exposed to a working medium fluid flowing over the suction surface.

5. The turbomachinery blade of claim 1 or 2 wherein the medial segment has a descending surface having a plurality of notional, descending tangent lines associated therewith and an ascending surface having a plurality of notional, ascending tangent lines associated therewith, any one of the descending tangent lines forming an angle of more than 0° but less than 180° with any of the ascending tangent lines.

6. The turbomachinery blade of claim 1 or 2 wherein the blade has a span and the medial segment extends across substantially the entire span.

7. The turbomachinery blade of claim 1 or 2 wherein the blade has a span and the medial segment is spanwisely localized.

8. A turbomachinery blade for use in a blade array, the blade comprising an airfoil having a root, a tip spanwisely spaced from the root, a suction surface and a pressure surface laterally spaced from the suction surface, the suction and pressure surfaces being joined together at a leading edge and at a trailing edge chordwisely spaced from the leading edge, at least part of the suction surface being representable as a continuous curve in the positive quadrant of a planar Cartesian coordinate system having abscissa and ordinate axes, the curve having a continuous first derivative and a second derivative and being oriented so that each point on the curve has a single ordinate value uniquely associated with each abscissa value and so that the values along the abscissa axis correspond to the chord of the airfoil and so that the first derivative at the ordinate axis is zero, the suction surface characterized in that the second derivative changes sign at least twice over a range of spanwise locations.

9. The turbomachinery blade of claim 8 characterized in that the second derivative changes sign exactly twice.

10. The turbomachinery blade of claim 8 wherein the range of spanwise locations embraces substantially the entire span.

11. The turbomachinery blade of claim 9 wherein the range of spanwise locations is spanwisely localized.

12. A turbomachinery blade array having a plurality of blades each comprising an airfoil having a root, a tip spanwisely spaced from the root, a suction surface and a pressure surface laterally spaced from the suction surface, the suction and pressure surfaces being joined together at a leading edge and at a trailing edge chordwisely spaced from the leading edge, the blades defining a plurality of interblade passages each bounded in part by the pressure surface of one of the blades and by the suction surface of a neighboring blade for guiding a stream of working medium fluid through the blade array, each passage also having a throat that extends across the passages, the suction surface of at least a subset of the blades having chordwisely separated, positively curved forward and aft segments and a negatively curved medial segment chordwisely intermediate the forward and aft segments, the medial segment being approximately chordwisely aligned with the throat.

13. The blade array of claim 12 wherein the medial segment blends nonabruptly with the forward and aft segments.

14. The blade array of claim 12 wherein the blade has a span and the medial segment extends across substantially the entire span.

15. The blade array of claim 12 wherein the blade has a span and the medial segment is spanwisely localized.

16. The blade array of claim 12 wherein the array is rotatable about a longitudinal axis.

17. The blade array of claim 12 wherein the throat extends between the trailing edge of each airfoil and the suction surface of the neighboring airfoil.

18. A turbomachinery blade array having a plurality of blades each comprising an airfoil having a root, a tip spanwisely spaced from the root, a suction surface and a pressure surface laterally spaced from the suction surface, the suction and pressure surfaces being joined together at a leading edge and at a trailing edge chordwisely spaced from the leading edge, the blades defining a plurality of interblade passages each bounded in part by the pressure surface of one of the blades and by the suction surface of a neighboring blade for guiding a stream of working medium fluid through the blade array, the fluid stream within at least a subset of the passages having a chordwisely localized region of expansion extending across the passage, the expansion region being associated with fluid turning at the trailing edge of one of the blades and having a first end adjacent the trailing edge of the one blade and a second end adjacent the suction surface of the neighboring blade, the suction surfaces that bound at least some of the subset of passages having chordwisely separated, positively curved forward and aft segments and a negatively curved medial segment chordwisely intermediate the forward and aft segments, the medial segment being substantially chordwisely aligned with the second end of the expansion region.

19. The blade array of claim 18 wherein the medial segment blends nonabruptly with the forward and aft segments.

20. The blade array of claim 18 wherein the blade has a span and the medial segment extends across substantially the entire span.

21. The blade array of claim 18 wherein the blade has a span and the medial segment is spanwisely localized.

22. The blade array of claim 18 wherein the array is rotatable about a longitudinal axis.

23. The blade array of claim 18 wherein a chordwisely localized region of compression extends across the passage aft of the region of expansion.

24. The blade array of claim 23 wherein the region of compression is chordwisely aligned with the positively curved aft segment.

25. The turbomachinery blade of claim 1 or 2, the blade being suitable for operation in a transonic or supersonic environment.

26. The turbomachinery blade of claim 1 or 2, wherein the forward, aft and medial segments are constituents of a chordwisely localized surface depression.

27. A turbomachinery blade for use in a blade array, the blade comprising an airfoil having a root, a tip spanwisely spaced from the root, a suction surface and a pressure surface laterally spaced from the suction surface, the suction and pressure surfaces being joined together at a leading edge and at a trailing edge chordwisely spaced from the leading edge, the suction surface having a chordwisely localized depression.

28. The turbomachinery blade of claim 27 wherein the depression is substantially exposed to a working medium fluid flowing over the suction surface.

* * * * *

UNITED STATES PATENT AND TRADEMARK OFFICE

CERTIFICATE OF CORRECTION

PATENT NO. : 6,358,012 B1
DATED : March 19, 2002
INVENTOR(S) : J. Brent Staubach It is certified that error appears in the above-identified patent and that said Letters Patent is hereby corrected as shown below:

Column 5,
Lines 64-67, after the phrase "the suction surface having" delete "chordwisely separated, positively curved forward and aft segments and a negatively curved medial segment chordwisely intermediate the forward and aft segments." and insert -- a positively curved forward segment located entirely forwardly of a medial segment and a positively curved aft segment located entirely rearwardly of the medial segment, the medial segment being negatively curved --.

Column 6,
Lines 7-10, after the phrase "the suction surface having" delete "chordwisely separated, convex forward and aft segments and a concave medial segment chordwisely intermediate the forward and aft segments" and insert -- a convex forward segment located entirely forwardly of a medial segment and a convex aft segment located entirely rearwardly of the medial segment, the medial segment being concave. --

Signed and Sealed this

Twenty-seventh Day of January, 2004

JON W. DUDAS
*Acting Director of the United States Patent and Trademark Office*